United States Patent [19]

Brue Moya et al.

[11] Patent Number: 4,632,418

[45] Date of Patent: Dec. 30, 1986

[54] COLLAPSIBLE SKI

[76] Inventors: Manuel Brue Moya; Juan Escolies Bordoy, both of Via Augusta 203, Barcelona, Spain

[21] Appl. No.: 622,294

[22] Filed: Jun. 19, 1984

[30] Foreign Application Priority Data

Jun. 23, 1983 [ES] Spain ..... 273.128[U]
Jun. 11, 1984 [ES] Spain ..... 279.918[U]

[51] Int. Cl.[4] ..... A63C 5/02

[52] U.S. Cl. ..... 280/603; 403/101; 403/102

[58] Field of Search ..... 280/603; 403/101, 102

[56] References Cited

U.S. PATENT DOCUMENTS 526,216 9/1894 Bremer ..... 280/603
2,332,404 10/1943 Smith ..... 280/603
3,689,093 9/1972 Meland ..... 280/603

FOREIGN PATENT DOCUMENTS 107557 6/1943 Finland ..... 280/11.13
71224 9/1943 Norway ..... 280/11.16

*Primary Examiner*—John J. Love
*Assistant Examiner*—Joseph G. McCarthy
*Attorney, Agent, or Firm*—Cushman, Darby & Cushman

[57] ABSTRACT

A collapsible ski skate is provided with front and rear portions each having ends pivotally connected by means of first and second pairs of parallel strips with the first pair connected to the ends of the second pair of strips with the second pair of strips being pivotally connected to a spindle member and pairs of complementary bevel surfaces on the respective front and rear portions of the skate which interengage when the skate is fully unfolded.

3 Claims, 7 Drawing Figures

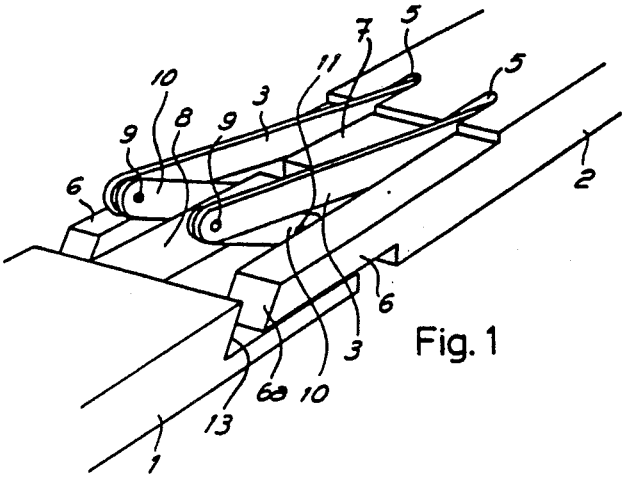
Fig. 1
Fig. 4
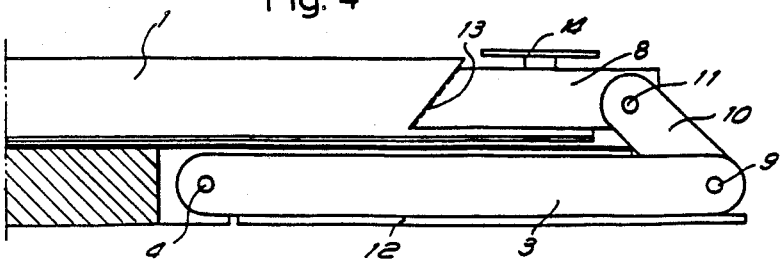

COLLAPSIBLE SKI

The present invention refers to a collapsible ski, which upon specifically having such a characteristic, is extremely advantageous as related to conventional skies which are non-collapsible as is widely known. Thus, this ski when collapsed is highly remarkably reduced in size and thereby very little space is taken making it extremely easy to be kept, stored and handled.

This collapsible ski comprises two mutually pivoted lengths provided with a set of connecting rods and tierods that enable the disengagement of these two lengths and their subsequent juxtaposition by a suitable rotation; the ski also comprising blocking means operable in the unfolded position and other supplemental flexible means enhancing the stability in the wearing position of the ski.

The description would be better understood if reference is made to the annexed drawings wherein two practical embodiments of the collapsible ski are shown and cited only by way of a non-exhaustive example of the scope of the present invention.

In said drawings:

FIG. 1 is a perspective view of the ski area provided with the arrangement enabling the ski to be folded and unfolded in a transition position.

FIG. 4 is a similar view showing the ski already folded.

Figure 2:
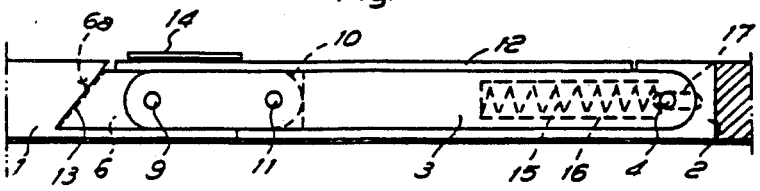
FIG. 2 is a side elevation detail showing an unfolded ski.

Referring to the drawings, the collapsible ski being herein disclosed comprises the associated skate divided respectively, according to the invention, in two front and rear sides -1- and -2- mutually privotedly engaged at the boot fastening area by means of two connecting rods -3- made by respective strips being at one end pivoted on the shafts -4- into respective notches -5- of the skate top side; these connecting rods playing upon slits defined between two arms -6- of the skate side -2-, an appendage -7- of said side, and a spindle -8- of the skate front side -1-; being said connecting rods -3- are pivoted at their ends opposite notches 5 end by means of respective shafts -9- to the associated tierods -10- made by other shorter strips which at the strip end opposed to the strip pivoting end with connecting rods -3- are being left pivoted on the shaft -11- to the spindle -8-; these tierods playing between said spindle and the arms -6-.

At a ski unfolded position, the connecting rods -3- together with tierods -10- are aligned and housed in the slits formed between the arms -6-, the appendage -7- and the spindle -8- and at said position a plate -12- fixed at the top edge of the connecting rods -3- is being left flush with the top side of the two skate sides -1- and -2-, all this as can be seen in the FIG. 2 of the drawings. At this ski unfolded position, a bevel -6*a*- of the free end of the arms -6- engages an associated inclined plane entrant -13- of the ski front side -1-. On the spindle -8- is rotatably mounted a lug -14- susceptible of being transversely arranged in relation to a slit provided in the plate -12- at a position which locks the ski in an unfolded position; said lug being thereby collapsibly placed by pivoting about the lug shaft on the plate -12- in a way the lug is remaining flat over such a plate to enable the treading with the skier's boots when the ski is used.

Figure 3:
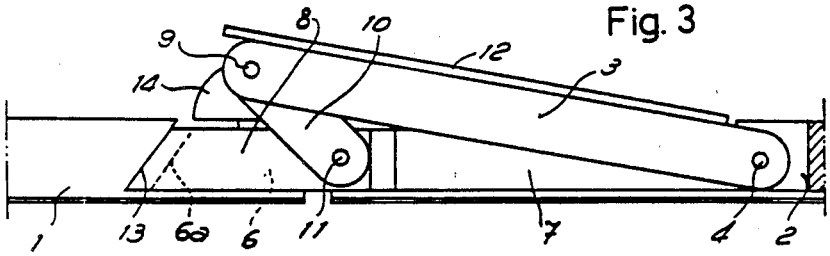
FIG. 3 is a similar view of FIG. 2 showing a transitory position during the motion of the arrangement members when the ski is being prepared to be folded.

The ski is being folded first by unlocking ski sides -1- and -2- and placing the locking lug -14- in an aligned and erected position with respect to said slit of the plate -12-, the rotation of the connecting rods -3- and tierods -10- is thus allowed firstly upwardly as can be seen in the FIG. 3 and then downwardly until the connecting rods -3- are downwardly located as related to the ski front side -1- below which the rear side -2- is folded and backed as can be seen in the FIG. 4.

Advantageously, the assembly comprises a spring -15- being housed in a cavity -16- of the skate rear side -2- backing between the shaft -4- of the connecting rods -3- which play in a slide -17- of the ski side -2- and the bottom of said cavity -16- which spring -15- with said arrangement is tending to push said side -2- against the side -1- and keeping the bevels -6*a*- of the arms -6- engaged at the inclined plane entrants -13- helping in this way to maintain the ski in an unfolded position.

Figure 5:
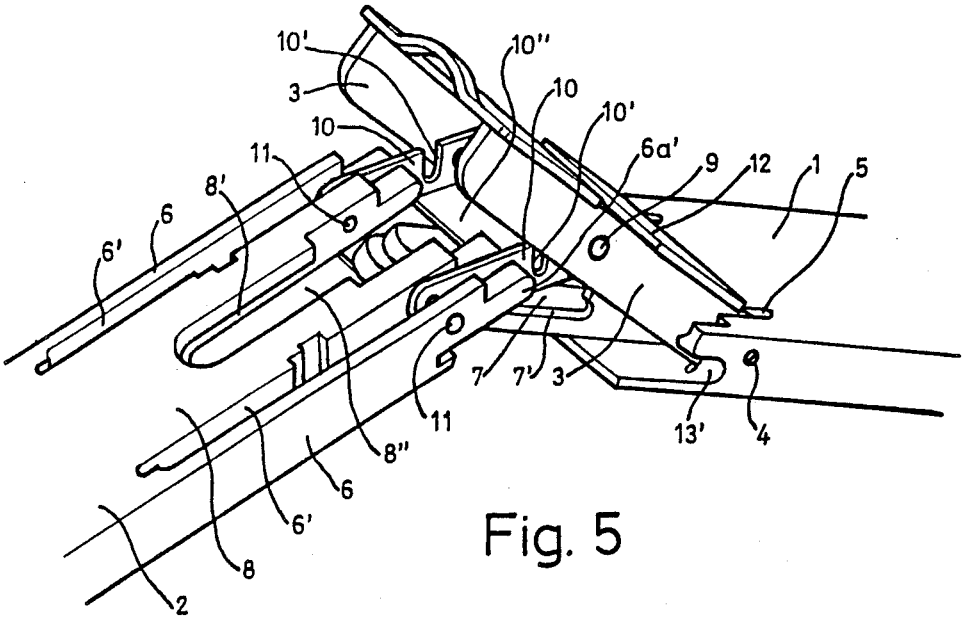
FIG. 5 is a perspective view of the pivoting area of another embodiment of the ski with its two lengths seen separated.
Figure 6:
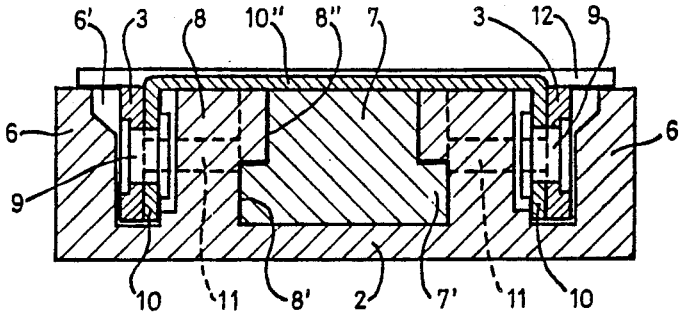
FIG. 6 is a cross-sectional view of this ski pivoting area according to FIG. 5 in the engagement position.
Figure 7:
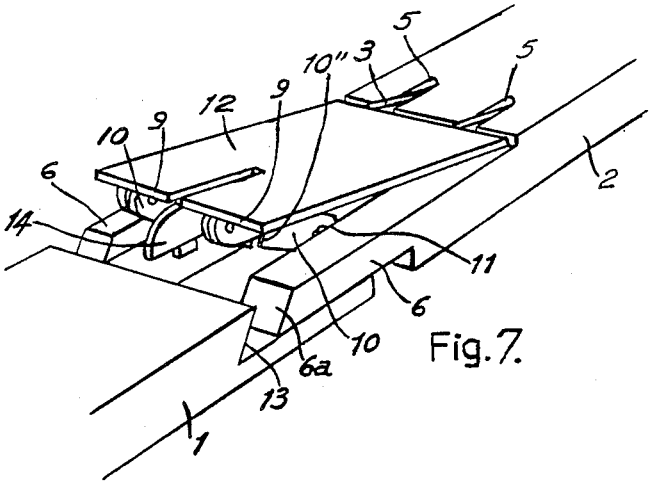
FIG. 7 is a perspective view of the ski of FIG. 3.

In the embodiment of FIGS. 5 and 6 the connecting rods -3- at the engagement position of the two ski lengths are housed into respective parallel grooves -6'- close to the edges of length -2- being the two tierods -10- mutually linked by means of a transversal length -10'-.

The appendage -7- is showing sideways and at the end a projection -7'- slidably engageable into guides -8'- provided sideways in an axially undercut -8''- made in the spindle -8- of the ski length -2-. The provision considerably ensures the engagement between the two ski sides at the ski unfolded position ready for use; the connecting rods -3- and the tierods -10- at this position remain parallel and aligned and juxtaposed and housed in the grooves -6'- of the length -2- (FIG. 2) backing on the lengths -1- and -2- engaging a top plate -12- associated with the connecting rods -3-; being the plate center part divided by leaving a hollow where a transversal length -10'- of the tierods -10- is engaged at said engagement position.

This engagement is supplemented by means of the engagement of respective side projections -6*a*'- of the head of the ski length -2- into the associated entrants -13'- provided sideways at the head of the other length -1- which can be clamped with any type of retainer.

The presence of some axial compression flexible means being determined by respective transversal notches -10'- provided in the tierods -10- and enabling such a compression in these tierods when at the engagement they are found under the axial pressure effect between pivoting means -9- to the connecting rods and those -11- to the length spindle -2- being also helping the above mentioned engagement.

From the description can be understood the highly engagement safety between the two ski sides, obtained easily and feasibly upon engaging the appendage -7- into the guides of the spindle -8-, the projections -6*a*'- into the entrants -13'- and the tierods -10- resiliently operated.

We claim:

1. A collapsible ski comprising a skate having a front portion and a rear portion each having respective ends, connecting means pivotally joining said ends, said connecting means being located in the area of said ski where the boot of the user is placed in use, said connecting means including two parallel first strips each having opposite ends, said rear portion of said skate having spaced notches each receiving one of said opposite ends of a said strip on pivot means in each said notch, said connecting means including a second pair of strips each having first and second ends, each other of said opposite ends of said first strips being pivotally connected respectively to a said first end of a said second strip, said front portion of said skate having side edges and, adjacent said end thereof, a spindle disposed inwardly from said side edges, said second ends of said second strips being pivotally connected to said spindle, said first and second strips extending substantially parallel to one another when said ski is folded and unfolded, said rear portion having a pair of parallel arms each terminating in a bevel surface and disposed outwardly of said strips, said front portion of said skate having adjacent said spindle a pair of spaced bevel surfaces complementary to said bevel surfaces of said arms, said arms having a length such that, when said ski is fully unfolded said respective pairs of bevel surfaces will engage one another, said first strips having top edges on which is mounted a plate which, is the unfolded condition of said ski, will lie substantially flush with the surface of said front and rear portions, said ski including locking means for maintaining said portions in the unfolded position.

2. The invention as claimed in claim 1, wherein said locking means comprises a flat lug pivotably mounted on said spindle of said front portion, said plate having a slit for receiving a portion of said lug when said plate is flush with said surfaces of said portions, said portion of said lug being foldable onto said plate to effect locking of said front and rear portions.

3. The invention as claimed in claim 2, wherein said rear portion includes spring means adjacent said end thereof and disposed in a cavity, said one ends of said first strips being pivoted of a shaft which is slidable in a slot, said spring acting on said shaft at one end of said spring and on the bottom of said cavity at the other end of said spring thereby tending to draw said front and rear portions together by means of said interconnected strips.

* * * * *